US010207383B2

(12) United States Patent
Huber et al.

(10) Patent No.: US 10,207,383 B2
(45) Date of Patent: Feb. 19, 2019

(54) FINISHING DEVICE

(71) Applicant: Supfina Grieshaber GmbH & Co. KG, Wolfach (DE)

(72) Inventors: Michael Huber, Bad Rippoldsau (DE); Marcus Stephan, Fischerbach (DE); Simon Wolber, Schiltach (DE); Anita Hug, Wolfach (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 78 days.

(21) Appl. No.: 15/324,265

(22) PCT Filed: Jul. 23, 2015

(86) PCT No.: PCT/EP2015/066824
§ 371 (c)(1),
(2) Date: Jan. 6, 2017

(87) PCT Pub. No.: WO2016/012526
PCT Pub. Date: Jan. 28, 2016

(65) Prior Publication Data

US 2017/0197288 A1 Jul. 13, 2017

(30) Foreign Application Priority Data

Jul. 25, 2014 (DE) ..... 10 2014 214 719

(51) Int. Cl.
*B24B 5/42* (2006.01)
*B24B 21/02* (2006.01)
*B24B 35/00* (2006.01)

(52) U.S. Cl.
CPC ..... *B24B 5/42* (2013.01); *B24B 21/02* (2013.01); *B24B 35/00* (2013.01)

(58) Field of Classification Search
CPC ..... B24B 21/02; B24B 35/00
USPC ..... 451/303
See application file for complete search history.

(56) References Cited

U.S. PATENT DOCUMENTS 3,800,479 A * 4/1974 Heyek ..... B24B 5/35 451/307
4,993,191 A * 2/1991 Judge ..... B24B 19/12 451/303
5,683,291 A * 11/1997 Humpert ..... B24B 5/42 451/168
5,695,391 A * 12/1997 Steinwender ..... B24B 5/42 451/168

(Continued)

FOREIGN PATENT DOCUMENTS

DE 4444239 A1 6/1996
DE 202010006480 U1 8/2010

(Continued)

*Primary Examiner* — George Nguyen
(74) *Attorney, Agent, or Firm* — Leydig, Voit & Mayer, Ltd.

(57) ABSTRACT

A finishing device has a pressing arm and a pressing tool for pressing a finishing tool against a workpiece, and method for setting up the device, the device being provided with a first connecting device for connecting a base support to the pressing arm, a second connecting device for connecting the base support to the pressing tool and a setting device for setting the orientation and/or position of the base support on the pressing arm.

17 Claims, 11 Drawing Sheets

(56) References Cited

U.S. PATENT DOCUMENTS

| | | | | |
|---|---|---|---|---|
| 5,755,615 | A * | 5/1998 | Kiriyama | B24B 5/42 451/190 |
| 5,865,669 | A * | 2/1999 | Kiriyama | B24B 19/12 451/11 |
| 5,951,377 | A * | 9/1999 | Vaughn | B24B 5/42 451/14 |
| 6,203,402 | B1 * | 3/2001 | Hildebrandt | B24B 5/42 451/303 |
| 6,309,287 | B2 * | 10/2001 | Martin, III | B24B 19/12 451/303 |
| 6,383,063 | B1 * | 5/2002 | Ohashi | B24B 5/42 451/303 |
| 6,454,638 | B2 * | 9/2002 | Bonachera | B24B 5/42 451/302 |
| 8,408,973 | B2 * | 4/2013 | Grabsch | B24B 35/00 451/168 |
| 8,517,804 | B2 * | 8/2013 | Weigmann | B24B 21/02 451/168 |
| 2010/0236314 | A1 | 9/2010 | Weigmann et al. | |

FOREIGN PATENT DOCUMENTS

| | | | |
|---|---|---|---|
| DE | 202013005504 | U1 | 6/2013 |
| DE | 202014000094 | U1 | 2/2014 |
| EP | 1447170 | A1 | 8/2004 |
| EP | 2212058 | B1 | 8/2010 |
| GB | 2537516 | A | 10/2016 |

* cited by examiner 10
74
96
IX
X
98
98
88
60
44
86

90
72
74
68
92

94
X1

112
104
100
102
110
108
106
118
116
88

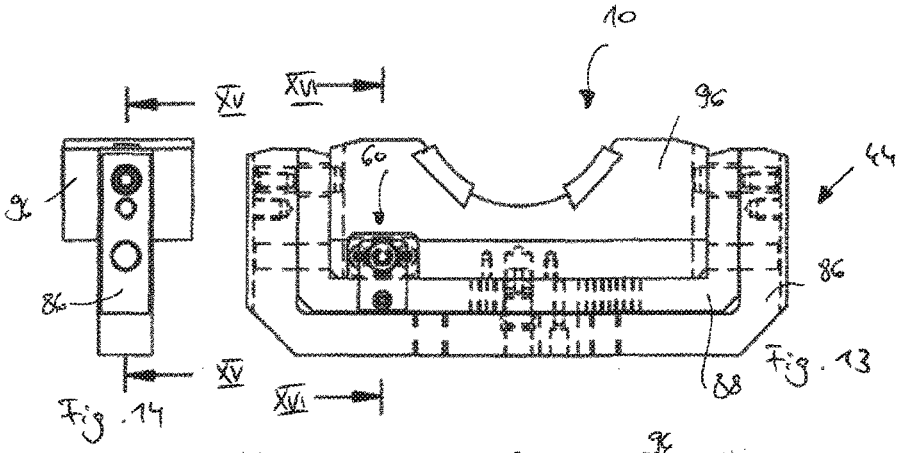
Fig. 14
Fig. 13
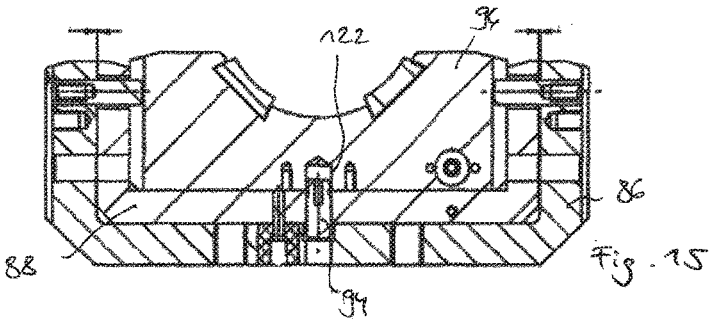
Fig. 15
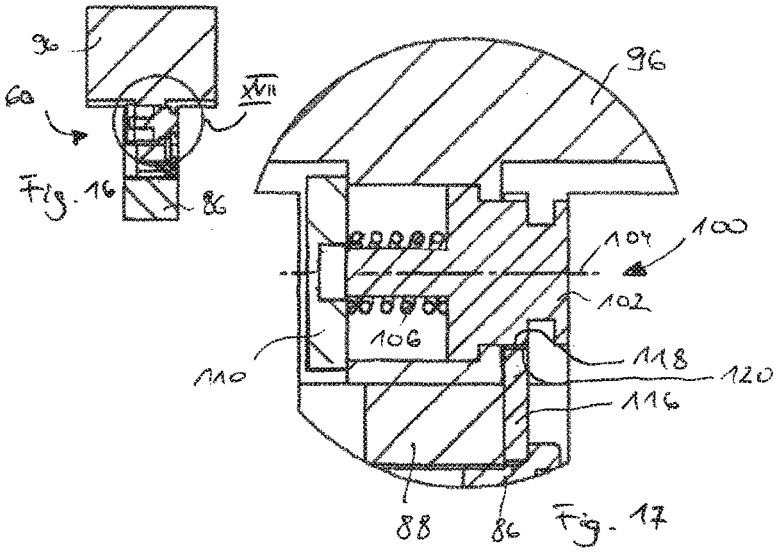
Fig. 16
Fig. 17

FINISHING DEVICE

CROSS-REFERENCE TO RELATED APPLICATIONS

This application is a U.S. national stage application under 35 U.S.C. § 371 of International Application No. PCT/EP2015/066824, filed on Jul. 23, 2015, and claims benefit to German Patent Application No. DE 10 2014 214 719.0, filed on Jul. 25, 2014. The International Application was published in German on Jan. 28, 2016, as WO 2016/012526 A1 under PCT Article 21(2).

FIELD

The invention relates to a finishing device, comprising a pressing arm and a pressing tool for pressing a finishing tool against a workpiece.

BACKGROUND

Finishing devices are known for example from EP 2 212 058 B1 and DE 20 2013 005 504 U1. They are used to press a finishing tool (for example a finishing belt) against a workpiece surface to be finished. In the process, the workpiece rotates and is simultaneously moved back and forth in an oscillating manner in parallel with the rotational axis. This results in a cross-grinding structure that is characteristic of the finishing process.

In the known finishing devices, the pressing tool is connected to the pressing arm by means of a simple screwed joint.

SUMMARY

An aspect of the invention provides a finishing, comprising: a pressing arm; a pressing tool, configured to press a finishing tool against a workpiece; a first connection apparatus configured to connect a base support to the pressing arm; a second connection apparatus configured to connect the base support to the pressing tool; and an adjusting apparatus configured to adjust an orientation and/or position of the base support on the pressing arm.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 13-17 views corresponding to FIG. 7 to 11, respectively, with the connection apparatus being shown in its locked state;

DETAILED DESCRIPTION

Figure 1:
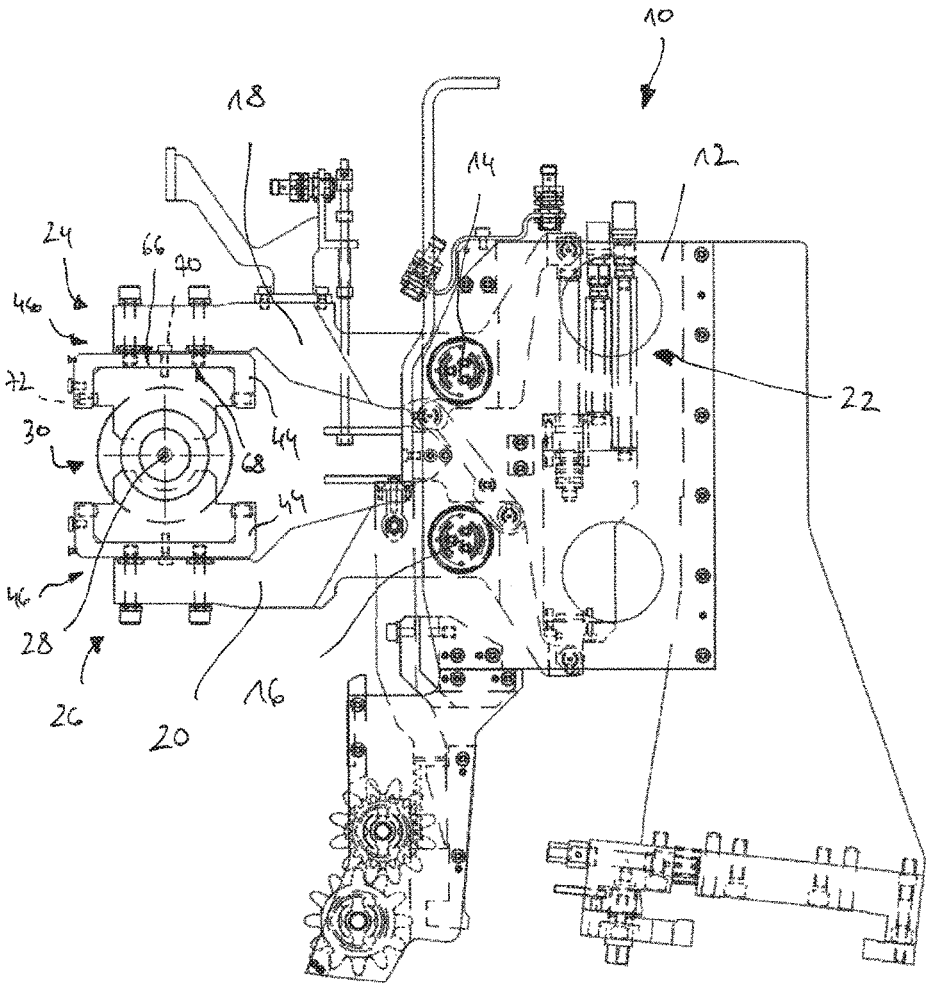
FIG. 1 a side view of an embodiment of a finishing device, comprising a pressing tool in the form of a setup tool and comprising a setup workpiece.

An aspect of the present invention is to simplify the mounting of a pressing tool, e.g., those discussed in the Background.

An aspect of the invention solves this problem in that said device is provided with a first connection apparatus for connecting a base support to the pressing arm, a second connection apparatus for connecting the base support to the pressing tool, and an adjusting apparatus for adjusting the orientation and/or position of the base support on the pressing arm.

According to an aspect of the invention, a base support is provided, the orientation and/or position of which can be adjusted relative to the pressing arm by means of an adjusting apparatus. When the base support assumes a desired orientation and/or position relative to the pressing arm, the base support can be fixed to the pressing arm by means of the first connection apparatus. The second connection apparatus is used to connect the base support to the pressing tool. The pressing tool then no longer has to be aligned relative to the pressing arm, but only connected to the base support. This means that a pressing tool which is to be installed due to wear or to prepare a new workpiece batch can be changed easily and rapidly.

Furthermore, this allows the second connection apparatus to connect pressing tools in the form of setup tools to the base support. Setup tools of this type may possibly be more stable than pressing tools which are used as working tools in order to press a finishing belt against a workpiece surface to be finished, for example.

It is preferable for the pressing tool to comprise a pressing belt and a pressing-belt holder. The pressing-belt holder comprises a connection portion for connecting to a connection portion of the base support. These connection portions form the second connection apparatus.

The pressing belt is in particular a flexible belt which can be used for finishing workpiece surfaces having different diameters. In the process, the pressing belt and the finishing belt wrap around the workpiece surface to be finished over a wrap angle that is greater than 10° or 20°, for example.

Furthermore, it is preferable for the finishing device to comprise a pressing tool having a rigid pressing portion. A pressing tool of this type is mechanically robust and can be used as a setup tool during preparations for the manufacture of a workpiece batch, for example, but alternatively or additionally can also be used as a working tool. Both a pressing tool in the form of a working tool and a pressing tool in the form of a setup tool are preferably connected to the base support such that they can be repeatedly detached, and therefore any pressing tools can be easily and rapidly detached from and connected to the base support.

If a pressing tool having a rigid pressing portion is used, it is preferable for the pressing portion to be shell-shaped or prism-shaped. A pressing portion of this type allows the pressing portion to come into extensive or multi-surface contact with surfaces of a setup workpiece or a workpiece to be machined. This contact simplifies the alignment of the base support relative to the pressing arm by means of the adjusting apparatus.

In a particularly preferred embodiment, it is provided that the first connection apparatus comprises an inclination-adjustable screwed joint, which forms the adjusting apparatus. A screwed joint of this type preferably comprises spherical washers and conical sockets, the inclination of which can be adjusted relative to one another such that the inclination of an axis of a screw that penetrates the spherical washer and conical socket can also be adjusted in order to determine an inclination of the base support relative to the pressing arm. A simple option for influencing the position of the base support on the pressing arm involves providing the base support or pressing arm with slots such that the position of the screw and thus the relative position of the base support relative to the pressing arm can be adjusted.

In a particularly preferred embodiment of the invention, it is provided that the base support comprises an in particular U-shaped holding frame for attachment to the pressing arm. A holding frame of this type makes it possible to mount a pressing tool on the base support in a simple manner and with precise tolerances.

The base support may be formed in one piece. The base support may also be formed in multiple pieces and for example may comprise an in particular U-shaped inner frame, which is held on the holding frame and is used to hold the pressing tool. It is possible for the inner frame to be mounted on the holding frame such that the inner frame can move along or about certain movement axes in order to movably mount the pressing tool relative to the base support.

It is preferable for the base support and the pressing tool to comprise contact surfaces which determine the relative position of the pressing tool on the base support. In this way, an adjustment of the orientation and/or position of the base support that is made to the base support relative to the pressing arm is transferred to the pressing tool.

In the simplest case, the second connection apparatus may be formed by a screwed joint.

Preferably, the second connection apparatus can be operated without tools and is in particular designed as a latching connection. This makes it possible to produce a quick-release interface between the pressing tool and the base support.

In particular, it is preferable for the second connection apparatus to comprise a latching element, which assumes a locking position for locking the pressing tool to the base support when at rest and can be transferred, in particular manually, into a released position in which the pressing tool can be detached from the base support. This makes it possible to particularly rapidly attach a pressing tool to the base support and to particularly rapidly detach the pressing tool from the base support. This is particularly advantageous if the base support has already been aligned relative to the pressing arm by means of the adjusting apparatus.

The above-described second connection apparatuses are also advantageous for finishing devices which do not comprise an adjusting apparatus for adjusting the position and/or orientation of the base support relative to the pressing arm and in which only a first connection apparatus is provided for connecting the base support to the pressing arm.

The problem stated at the outset is also solved by a method for setting up a finishing device of the above-described type, in which method a pressing tool designed as a setup tool is connected to the base support, the pressing tool is placed onto a setup tool or a workpiece to be finished in order to align the base support and determine the orientation and/or position of the base support, and also in which method the base support is attached to the pressing arm, the setup tool is removed and a pressing tool designed as a machine tool is connected to the base support.

In terms of the advantages and embodiments of the above-mentioned method, reference is made to advantages and embodiments of the above-described finishing device.

Additional features and advantages of the invention are found in the following description and the drawings of preferred embodiments.

A finishing device shown in FIG. 1 to 6 is denoted as a whole by reference sign 10. The finishing device 10 comprises a mount 12 having two pivot shafts 14, 16 for pivotally mounting one pressing arm 18, 20 in each case.

The finishing device 10 comprises a pressing drive 22, by means of which the pressing arms 18, 20 can be pivoted such that the free ends 24, 26 of the pressing arms 18, 20 are pressed towards an axis 28 of a setup workpiece 30 (cf. FIG. 1 to 3) or towards a workpiece axis 32 of a workpiece 34 to be finished (cf. FIG. 4 to 6), in particular in the form of a crankshaft.

Figure 4:
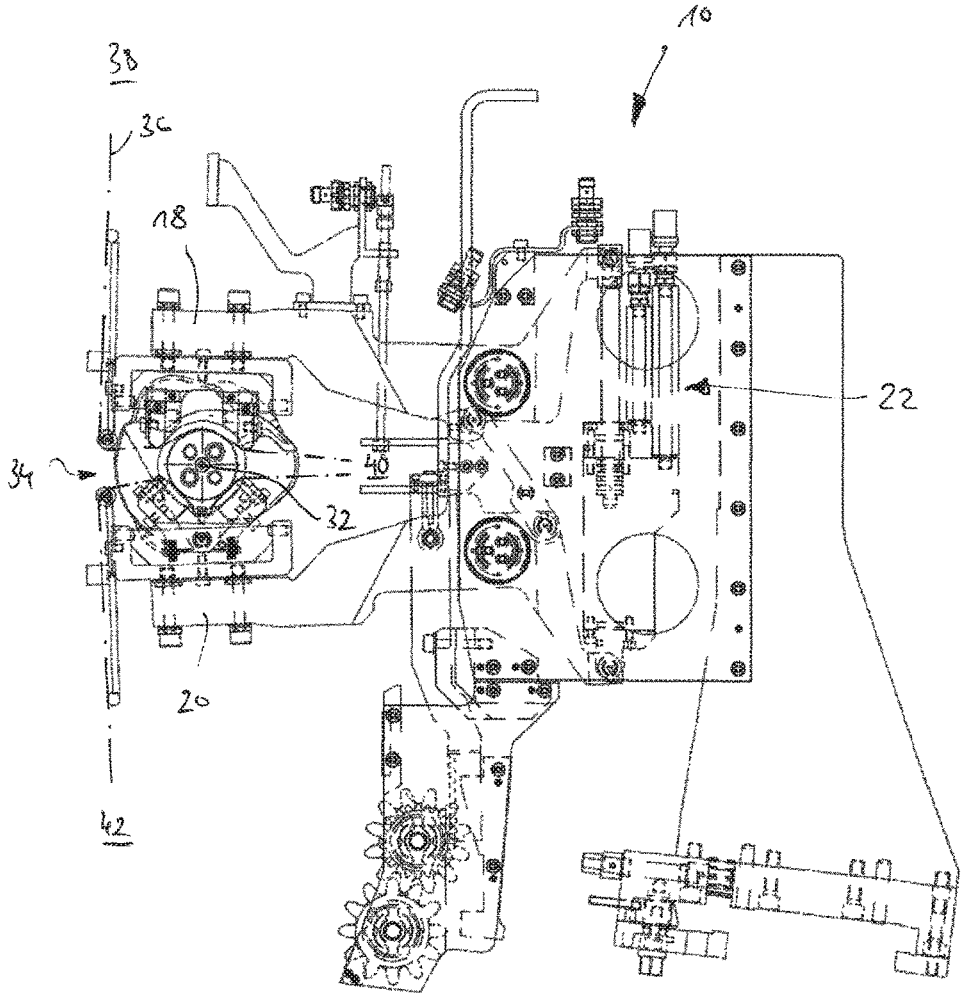
FIG. 4 a side view corresponding to FIG. 1, comprising a pressing tool in the form of a machine tool and comprising a workpiece to be machined.
Figure 5:
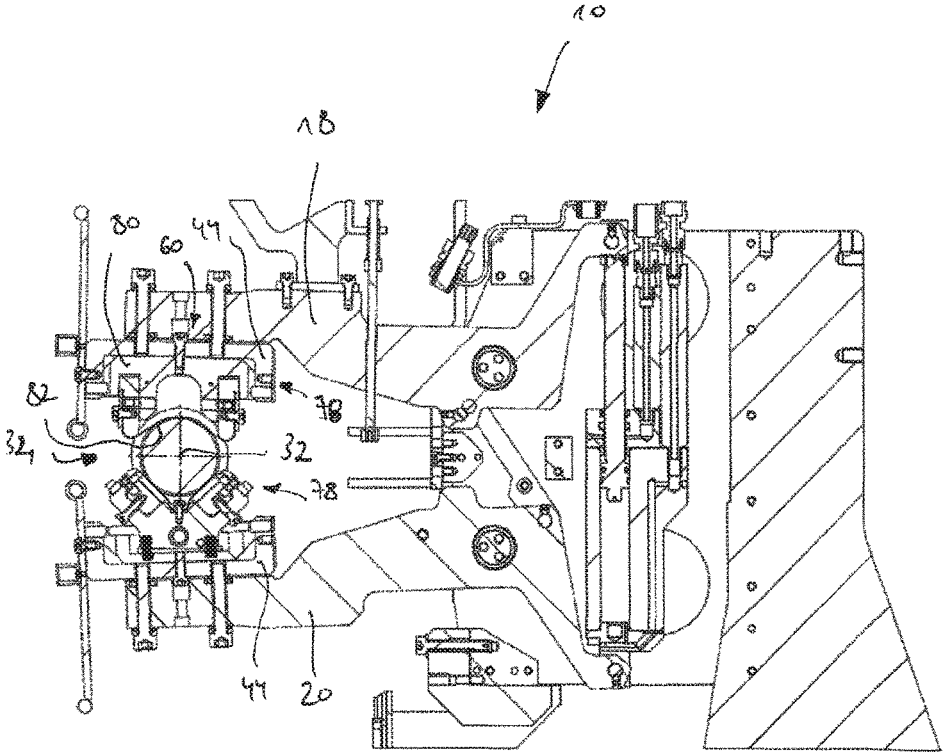
FIG. 5 a sectional view of the finishing device according to FIG. 4.
Figure 6:
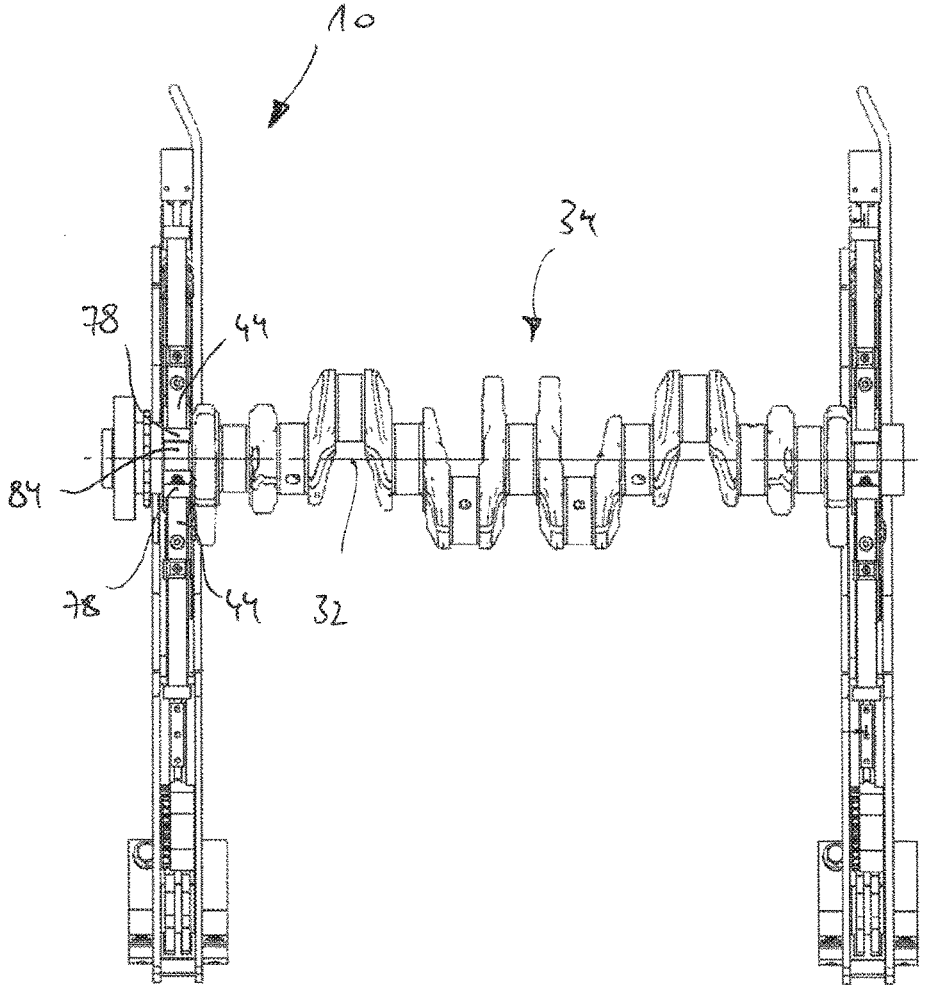
FIG. 6 a front view of the finishing device according to FIG. 4.
Figures 7, 8, 9, 10, 11:
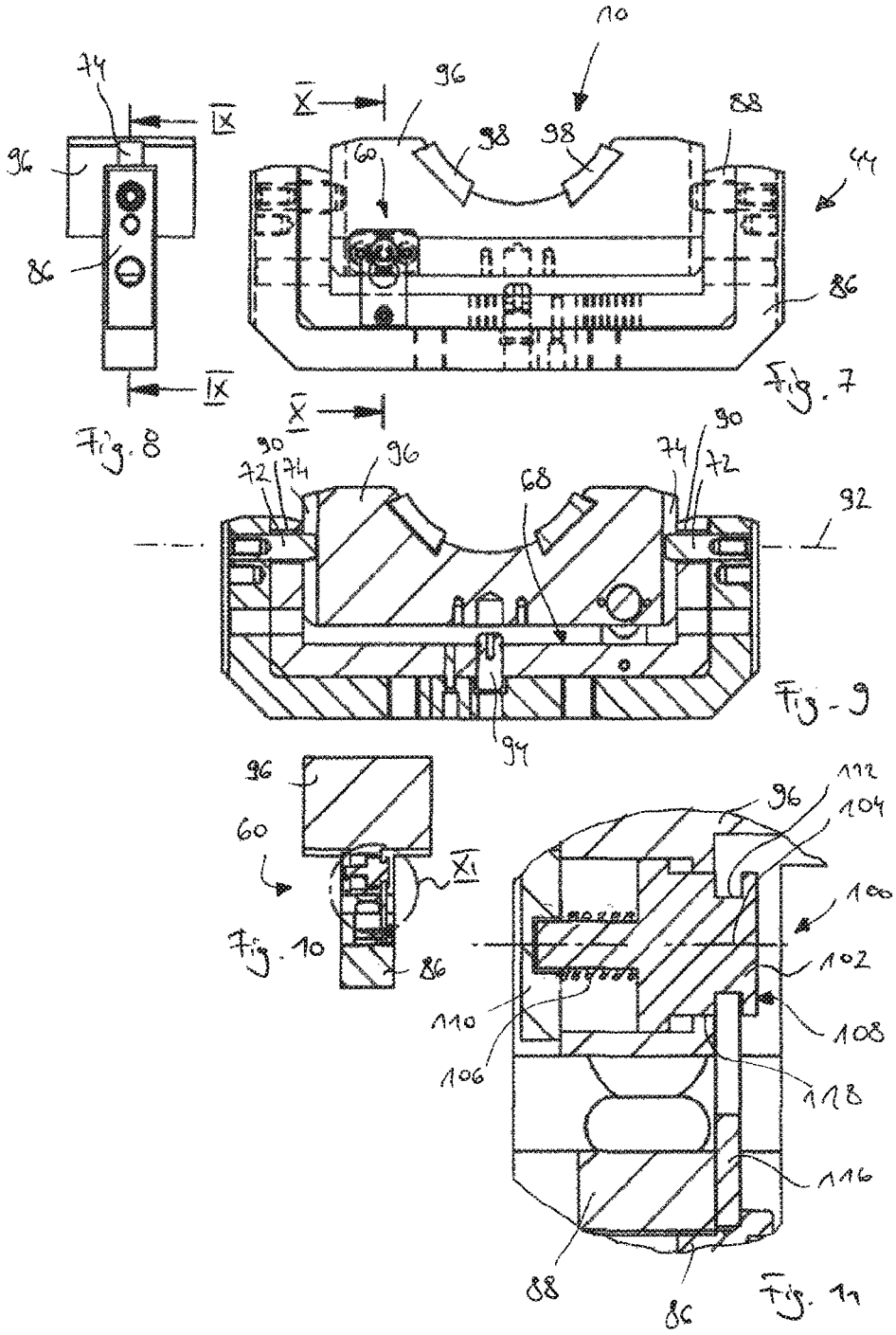
FIG. 7 a side view of another embodiment of a finishing device, with a connection apparatus for connecting a pressing tool to a base support being shown in its released state.
FIG. 8 a front view of the finishing device according to FIG. 7.
FIG. 9 a sectional view of the finishing device according to FIG. 7 along a sectional plane denoted in FIG. 8 by IX-IX.
FIG. 10 a sectional view of the finishing device according to FIG. 7 along a sectional plane denoted in FIG. 7 by X-X.
FIG. 11 an enlarged view of a detail denoted in FIG. 10 by XI.
Figure 12:
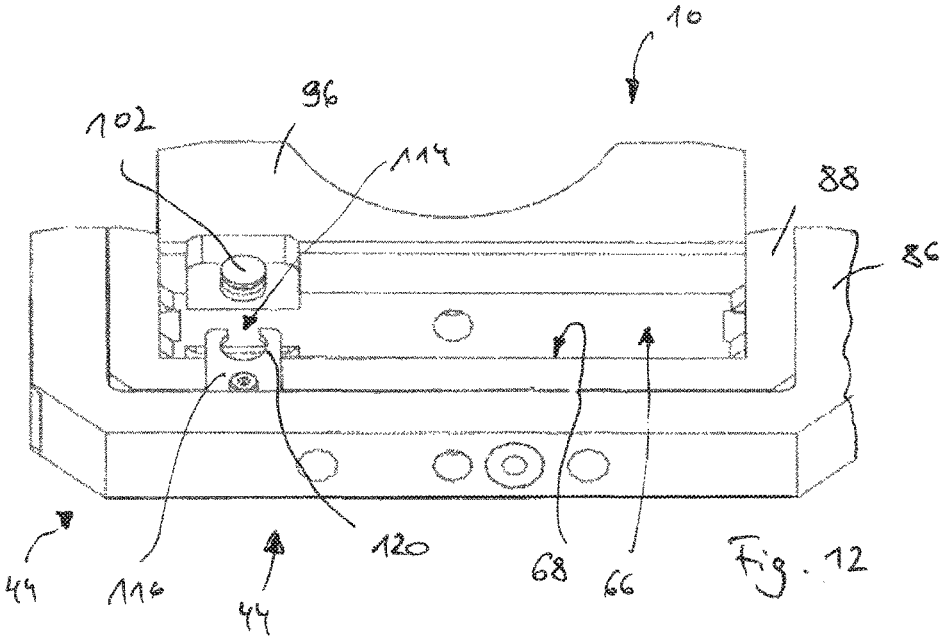
FIG. 12 a perspective view of the finishing device according to FIG. 7.
Figure 19:
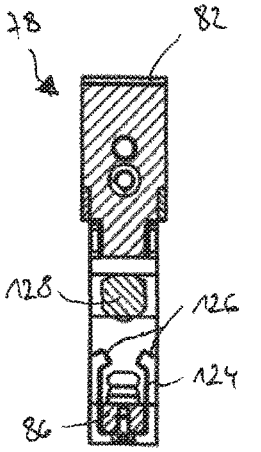
FIG. 19 a sectional view of the finishing device according to FIG. 18 along a sectional plane denoted in FIG. 18 by XIX-XIX.
Figure 18:
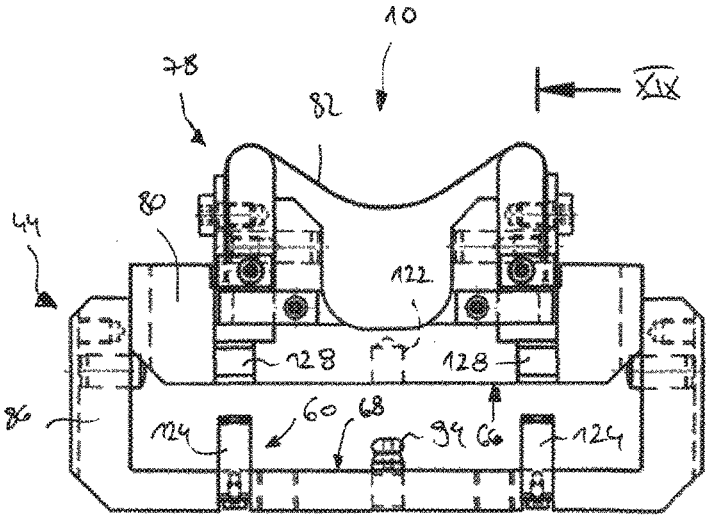
FIG. 18 a side view of another embodiment of a finishing device, with a connection apparatus for connecting a pressing tool to a base support being shown in its released state.
Figure 20:
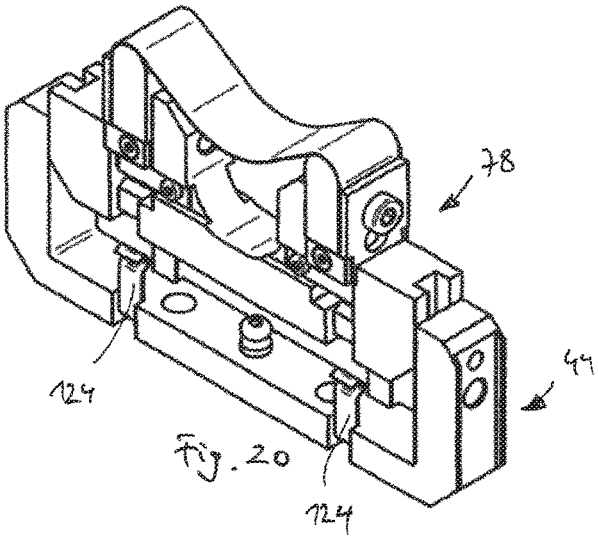
FIG. 20 a perspective view of the finishing device according to FIG. 18.
Figure 22:
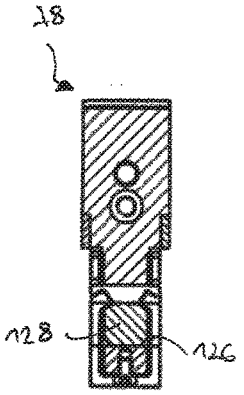
FIG. 21-23 views corresponding to FIG. 18 to 20, respectively, with the connection apparatus being shown in its locked state.
Figure 21:
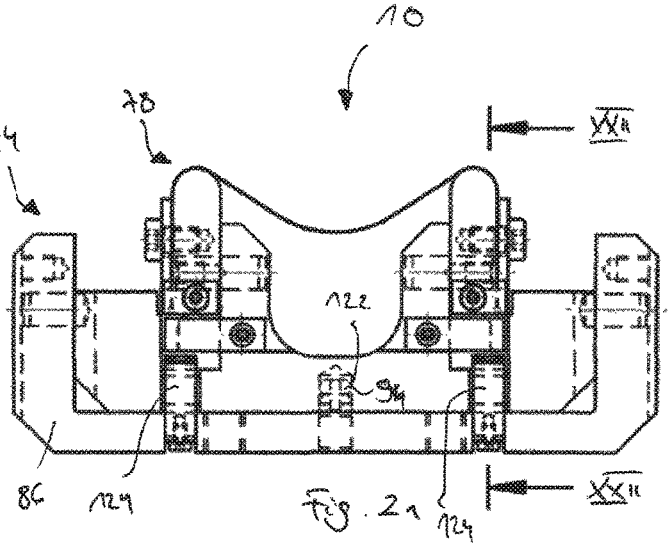
Figure 23:
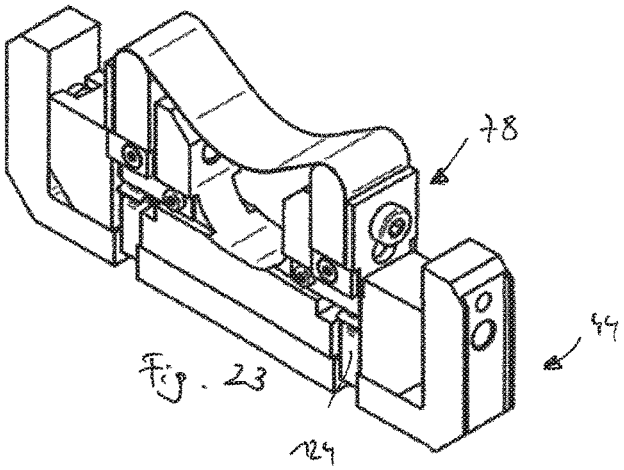

While the workpiece 34 is being finished, the pressing arms 18, 20 are used to transmit a pressing force to a pressing tool (described in the following) in order to press a finishing belt 36 against a surface of the workpiece 34 to be finished (cf. FIG. 4). In a conventional manner, the finishing belt 36 is removed from a supply 38, fed to the workpiece 34, deflected in the region of a deflection 40, guided back to the workpiece 34 and from here fed out of a collector 42.

Base supports 44 are provided in the region of the free ends 24, 26 of the pressing arms 18, 20, which supports are preferably U-shaped and are each connected to one of the pressing arms 18, 20 by means of a first connection apparatus 46.

The first connection apparatuses 46 comprise screws 48 which penetrate through-openings 50 in the pressing arms 18, 20. On either side of the pressing arm 18, 20, units 52, 54 are provided which each comprise a spherical washer and a conical socket and make it possible to adjust the inclination of the screws 48 within the through-openings 50. The screws 48 are screwed to the base support 44 by their ends 56. In this way, an inclination of the screws 48 that is adjusted by means of the units 52, 54 is transferred to the base support 44. Therefore, the units 52 and 54 together with the screws 48 each form an adjusting apparatus 58 for adjusting the position and/or orientation of the base support 44 relative to one pressing arm 18, 20 in each case.

Figure 2:
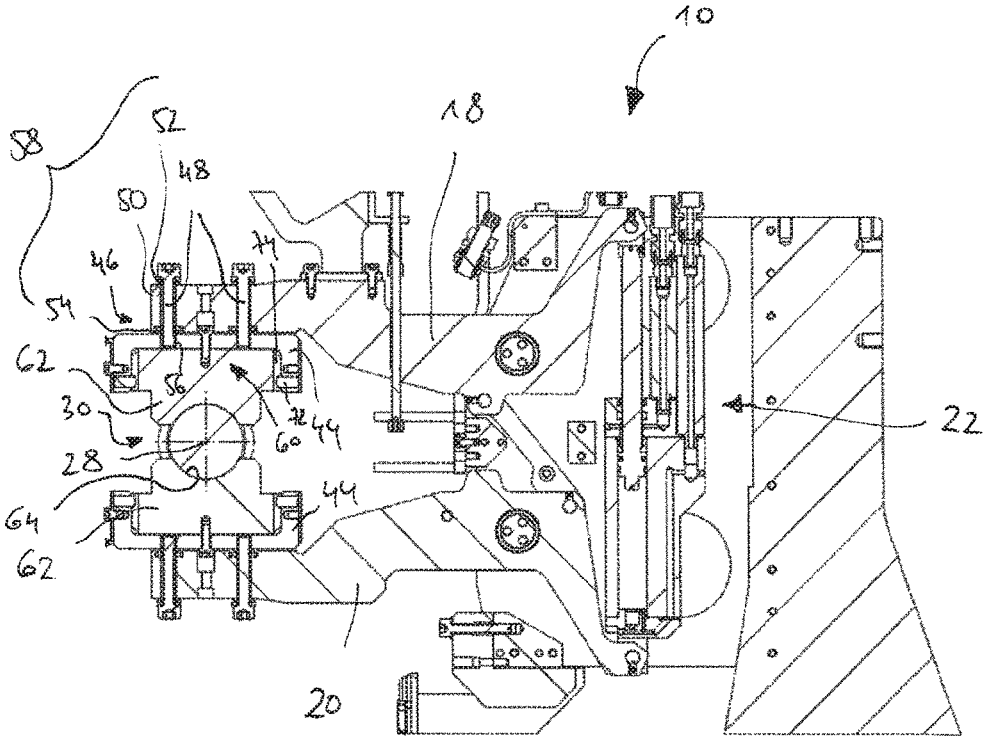
FIG. 2 a sectional view of the finishing device according to FIG. 1.
Figure 3:
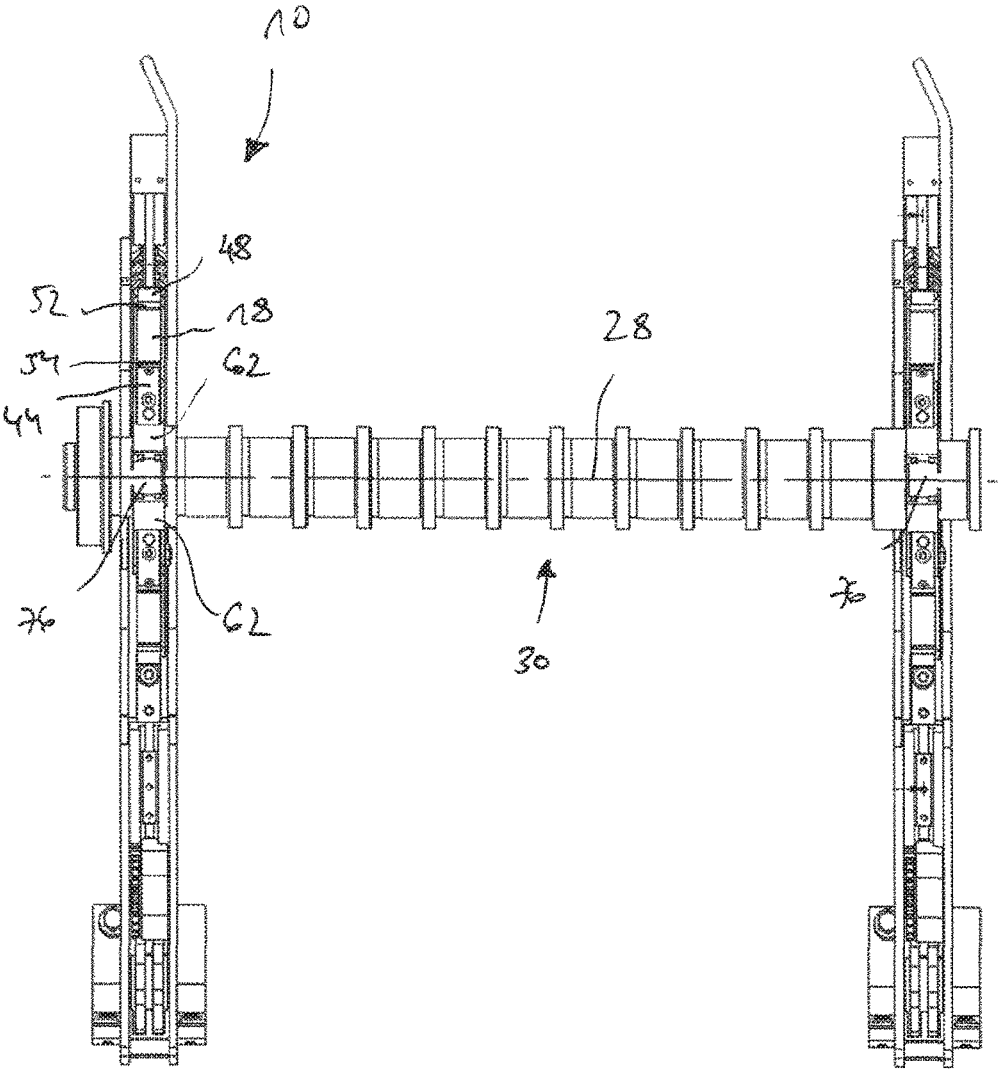
FIG. 3 a front view of the finishing device according to FIG. 1.

The base support 44 is connected to a pressing tool 62 by means of a second connection apparatus 60. The pressing tool 62 shown in FIG. 1 to 3 is a setup tool comprising a shell-shaped, rigid pressing portion 64.

The pressing tool 62 comprises a contact surface 66 for contacting an opposing surface 68 of the base support 44. In order to fix the pressing tool 62 to the base support 44, in the simplest case the second connection apparatus 60 comprises a screwed joint 70.

In order to additionally attach and/or mount the pressing tool 62 on the base support 44, additional guide elements 72 may be provided, for example bolts that are held on the base support 44 and interact with grooves 74 provided on the pressing tool 62.

In order to prepare the finishing of a workpiece batch of workpieces 34, a pressing tool 62 in the form of a setup tool is connected to the base support 44 and the first connection apparatus 52 is loosened. The pressing portion 64 is then brought into contact with a reference surface 76 of a setup tool 30 (cf. FIG. 3), and therefore the setup tool 62 is aligned relative to the pressing arm 18, 20 together with the base support 44. In the orientation and position of the base support 44 determined thereby, the first connection apparatus 46 is actuated in order to fix the base support 44 to the pressing arm 18, 20. The second connection apparatus 60 is then loosened and the pressing tool 62 in the form of the setup tool is removed from the base support 44 and replaced by a pressing tool 78 in the form of a machine tool; cf. FIG. 4 to 6.

The pressing tool 78 comprises a pressing-belt holder 80 for holding a pressing belt 82. In terms of its surfaces that cooperate with the base support 44, the pressing-belt holder 80 is identical to the pressing tool 62 in the form of the setup tool. Accordingly, the pressing-belt holder 80 can be connected to the base support 44 by means of the second connection apparatus 60. Here, the pressing tool 78 has already assumed a predetermined orientation and position relative to the pressing arm 18, 20. Therefore, after positioning the pressing tool 78 on a surface 84 of the workpiece 34 to be finished (by closing the tong-like pressing arms 18, 20), the surface 84 can immediately start being machined without additional adjustment processes being required.

While the workpiece 34 is being finished, said workpiece rotates about a workpiece axis 32. A rotary drive that is known per se and is therefore not shown is provided for this purpose. This rotational movement is overlaid with an oscillating movement, namely a movement in mutually opposing directions in parallel with the workpiece axis 32. An oscillating drive that is known per se and is therefore not shown either is provided for this purpose.

A finishing device 10 shown in FIG. 7 to 17 also comprises a base support 44 for mounting on a pressing arm 18, 20. The base support 44 comprises a U-shaped holding frame 86, in which an inner frame 88 that is also U-shaped is arranged. In order to attach the inner frame 88 to the holding frame 86, the bolts 72 that are screwed to the holding frame penetrate through-openings 90 in the inner frame 88. The bolts 72 are provided on opposite sides of the holding frame 86 and define a pivot axis 92.

Furthermore, a pin-shaped connection element 94 arranged on the base is provided for connecting the holding frame 86 and the inner frame 88, which element projects by a free end beyond an opposing surface 68 formed by the inner frame 88.

The inner frame 88 serves to detachably attach a pressing tool 96 which supports shell-shaped pressing elements 98.

In order to detachably connect the pressing tool 96 to the base support 44, a second connection apparatus 60 is provided that is designed as a latching connection.

The second connection apparatus 60 comprises a latching element 100 in the form of a pushbutton 102, which can be moved along an actuation axis 104.

Compressive force is applied to the pushbutton 102 by means of a spring 106 and attempts to transfer the pushbutton 102 from its released position (cf. FIG. 11) into its locked position (cf. FIG. 17). In the released position (FIG. 11), the spring 106 is compressed by a fitter exerting compressive force on a pressing face 108 of the pushbutton 102 that is greater than the force of the spring 106 in the opposite direction.

The spring 106 is supported on a plate 110 that is rigidly connected to the pressing tool 96. The pushbutton 102 comprises a narrowed portion 112 that is smaller than an access opening 114 in a mating element 116 (cf. FIG. 12). A widened portion 118 of the pushbutton 102 adjoining the narrowed portion 112 in the axial direction is slightly smaller than a receiving opening 120 in the mating element 116. The mating element 116 is attached to the base support 44, in particular to the inner frame 88.

In order to mount the pressing tool 96 on the base support 44, the pushbutton 102 is kept in its released position. As a result, while the pressing tool 96 is being inserted into the inner frame 88, the narrowed portion 112 of the pushbutton 102 is positioned at the level of the mating holder 116. The narrowed portion 112 can then be inserted into the receiving opening 120 in the mating holder 116 through the access opening 114.

While the pressing tool 96 is being mounted on the base support 44, the connection element 94 comes into engagement with a receiving portion 122 of the pressing tool 96 (cf. FIG. 15). In addition, the contact surface 66 of the pressing tool 96 comes into contact with the opposing surface 68 of the base support 44.

When an actuation force is not being exerted on the pressing surface 108 of the pushbutton, the tension on the spring 106 is released, and so the pushbutton 102 is transferred from the released position into the locked position. As a result, the widened portion 118 of the pushbutton comes into engagement with the receiving opening 120 in the mating element 116, and so the pressing tool 96 is locked to the base support 44.

Another embodiment of a finishing device 10 is shown in FIG. 18 to 23. The finishing device 10 comprises a second connection apparatus 60 that has at least one, and preferably two, spring clips 124. Said spring clips are fixed to the holding frame 86 of the base support 44 and comprise two insertion ends 126 that are spaced apart from one another.

The pressing tool 78, which is joined to the base support 44, comprises projections 128 which can be inserted between the insertion ends 126 and push them apart.

When the pressing tool 78 is completely joined to the base support 44, the contact surface 66 of the pressing tool 78 rests on the opposing surface 68 of the holding frame 86. The connection element 94 is joined to the receiving portion 122 (cf. FIG. 21). Furthermore, the springs 124 are in latched engagement with the projections 128; cf. FIGS. 22 and 23 in particular. In order to release the pressing tool 78 from the base support 44, it is sufficient to detach the pressing tool 78 from the base support 44 in the opposite direction to the joining direction, by overcoming the holding force of the spring clips 124.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A finishing device, comprising:

a pressing arm;

a pressing tool, configured to press a finishing tool against a workpiece;

a first connection apparatus configured to connect a base support to the pressing arm;

a second connection apparatus configured to connect the base support to the pressing tool; and an adjusting apparatus configured to adjust an orientation and/or position of the base support on the pressing arm, wherein the second connection apparatus is configured to be operable without tools and is configured as a latching connection.

2. The device of claim 1, wherein the pressing tool includes a pressing belt and a pressing-belt holder.

3. The device of claim 1, wherein the pressing tool includes a rigid pressing portion.

4. The device of claim 3, wherein the pressing portion is shell-shaped.

5. The device of claim 1, wherein the first connection apparatus includes an inclination-adjustable screwed joint, which forms the adjusting apparatus.

6. The device of claim 1, wherein the base support includes a holding frame configured to attached to the pressing arm.

7. The device of claim 6, wherein the base support includes an inner frame, wherein the inner frame is held on the holding frame, and wherein the inner frame is used to hold the pressing tool.

8. The device of claim 1, wherein the second connection apparatus is configured to be operable without tools.

9. The device of claim 1, wherein the second connection apparatus includes a latching element, wherein the latching element assumes a locking position for locking the pressing tool to the base support when at rest and can be transferred into a released position in which the pressing tool can be detached from the base support.

10. A method for setting up the device of claim 1, the method comprising:

connecting a pressing tool, configured as a setup tool, to the base support;

placing the pressing tool onto a setup tool or a workpiece to be finished, so as to align the base support and determine the orientation and/or position of the base support;

attaching the base support to the pressing arm;

removing the setup tool; and connecting a pressing tool designed as a machine tool to the base support.

11. The device of claim 1, wherein the adjusting apparatus is configured to adjust the orientation of the base support on the pressing arm.

12. The device of claim 1, wherein the adjusting apparatus is configured to adjust the position of the base support on the pressing arm.

13. The device of claim 11, wherein the adjusting apparatus is further configured to adjust the position of the base support on the pressing arm.

14. The device of claim 3, wherein the pressing portion is prism-shaped.

15. The device of claim 1, wherein the base support includes a U-shaped holding frame configured to attached to the pressing arm.

16. The device of claim 7, wherein the inner frame is U-shaped.

17. The device of claim 9, wherein the latching element is configured to be manually transferrable into the released position.

* * * * *